US005203633A

United States Patent [19]

Derby

[11] Patent Number: 5,203,633

[45] Date of Patent: Apr. 20, 1993

[54] SPREAD STRAP FLEXIBLE BULK CONTAINER

[75] Inventor: Norwin C. Derby, Dallas, Tex.

[73] Assignee: Super Sack Manufacturing Corporation, Dallas, Tex.

[21] Appl. No.: 765,206

[22] Filed: Sep. 25, 1991

Related U.S. Application Data

[62] Division of Ser. No. 616,217, Nov. 20, 1990, Pat. No. 5,076,710.

[51] Int. Cl.[5] ..... B65D 30/10; B65D 33/06

[52] U.S. Cl. ..... 383/17; 383/22; 383/107

[58] Field of Search ..... 383/6, 17, 22, 105, 383/107, 907

[56] References Cited

U.S. PATENT DOCUMENTS

| | | | |
|---|---|---|---|
| 1,189,480 | 7/1916 | Pomper | 383/6 |
| 2,580,796 | 1/1952 | Kleiss et al. | 383/6 |
| 4,207,937 | 6/1980 | Sandeman et al. | 383/17 |
| 4,248,364 | 2/1981 | Anderson | 383/6 |
| 4,300,608 | 11/1981 | Cuthbertson . | |
| 4,390,051 | 6/1983 | Cuthbertson . | |
| 4,493,109 | 1/1985 | Nattrass | 383/17 |
| 4,646,357 | 2/1987 | Nattrass | 383/6 |

*Primary Examiner*—Stephen P. Garbe
*Attorney, Agent, or Firm*—Michael A. O'Neil

[57] ABSTRACT

A spread strap flexible bulk container comprises a flexible bulk container having a plurality of panels seamed together to form a substantially square container with vertical seams connecting the panels located equidistant between adjacent corners of the container as opposed to the seams being located at the corners. Lift straps for supporting the container are attached at opposed ends to the container beginning at adjacent seams and extending diagonally upwardly to loop over the corners of the container. Bridge panel may be inserted into the container and each bridge panel attached to a single panel or a portion of a single panel.

18 Claims, 8 Drawing Sheets

SPREAD STRAP FLEXIBLE BULK CONTAINER

This is a divisional of copening application Ser. No. 07/616,217 filed on Nov. 20, 1990, now U.S. Pat. No. 5,076,710.

TECHNICAL FIELD

This invention relates generally to flexible bulk containers for receiving, transporting, and storing flowable materials, and more particularly, to flexible bulk containers having construction seams and lift straps offset from the corners of the container for a more even distribution of the load.

BACKGROUND AND SUMMARY OF THE INVENTION

Historically, flexible bulk containers have been used for receiving, storing, transporting and discharging flowable materials of all types. The containers are typically constructed in a square or vertically rectangular shape with lift straps attached to each of the uppermost corners of the square or rectangle.

Four panels are stitched together to form a perimeter wall in turn stitched to upper and lower panels to form the enclosed container. The panels used to form the perimeter wall are stitched together such that the seams connecting the panels are located in the corners of the container. The lift straps are typically stitched or otherwise attached to the uppermost corners of the container and adjacent to the seams connecting the panels to form the perimeter wall. Thus, through placement of the panel seams and the lift straps on the four corners, when filled, a substantial load is placed on the corners, thereby stressing the seam and threatening the integrity of the container.

In some instances, the ends of the lift straps are attached to the side panels at points away from the corner seams and extend up and over the corners of the top panel to form a loop. To reinforce the lift straps attached in such manner, a reinforced webbing material extends vertically down the side of the container at the location of attachment of the ends of the lift straps. Thus, when the container is filled, lifting of the straps diverts some of the load stress away from the seamed corners, but concentrates more of the load on the spread apart ends of the lift strap.

Although square in shape when empty, upon filling, flexible containers assume a more rounded shape. Bridge panels have historically been attached to the interior of the containers to achieve a less rounded configuration when the containers are filled. The bridge panels are typically the same height but smaller in width than the side panels forming the perimeter wall. Opposed edges of the bridge panel are attached vertically to adjacent side panels with the seam connecting the adjacent side panels located between the vertical attachment points of the bridge panel to thereby define a triangular shaped area between the bridge panel and the corner seam connecting the adjacent side panels to which the bridge panel is attached. Such configuration has historically caused construction problems requiring the handling of multiple panels while attaching the interior bridge panels.

The present invention overcomes the foregoing and other problems heretofore experienced in construction and use of flexible bulk containers. With reference to a first embodiment of the invention, four side panels are seamed together to form a perimeter wall in turn attached to a bottom panel and, in some cases, a top panel in such a manner that the corners of the bottom and top panels are seamed to the perimeter wall at points equidistant from the seams connecting adjacent side panels forming the perimeter wall. In other words, the seams connecting the side panels fall not at the corners, but at locations along the perimeter wall at midpoints between the corners of the top and bottom panels.

Lift straps are attached to the perimeter wall of the container with the opposed ends of the strap being attached beginning at adjacent seams connecting the panels and extending diagonally upwardly and away from the seam to the point where the perimeter wall is attached to the top panel. A center portion of the strap extends upwardly from the attachment points to the perimeter wall and diagonally over the corner of the top panel to form a loop above the corner. Thus, the straps are attached to the container along the sides as opposed to the corners of the container. Each strap is attached to its individual associated panel prior to seaming the panels to one another to simplify construction of the container.

By offsetting the side seams and attaching the straps to extend from the seams and loop over the corners, the load is more evenly distributed over the entire container with the added strength of a continuous piece of the container material extending around each corner. Such construction also allows for easier attachment of bridge panels. The panels are still attached to bridge the corners of the container, but because each corner is formed at the midpoint of a single panel, each bridge may be separately attached to a single panel prior to attaching the side panels together to form the perimeter wall. Therefore, instead of having to handle four panels at once to attach a single bridge panel, only two panels at a time are handled.

In a second embodiment of the invention, two side panels are attached along the bottom and both side edges to a single long panel to form the perimeter and bottom walls of a container. A top panel is then attached to the upper edge of the perimeter wall such that the corners of the top panel are attached at points along the perimeter wall equidistant from adjacent seams connecting the long panel to the side panels. Thus, the construction of the top portion of the container is the same as the construction of the top portion of the first embodiment container. Substitution of the single long panel for the bottom and two side panels of the container results in the top corners of the containers being offset from the bottom corners of the container. The lift straps may be attached in the same manner as in the first embodiment of the invention. As with the first embodiment of the invention, the positioning of the corners of the top panel away from the seams connecting the side panels results in a more even distribution of the load throughout the container, thereby reducing the threat of failure of a filled container.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION OF THE INVENTION

Figure 1:
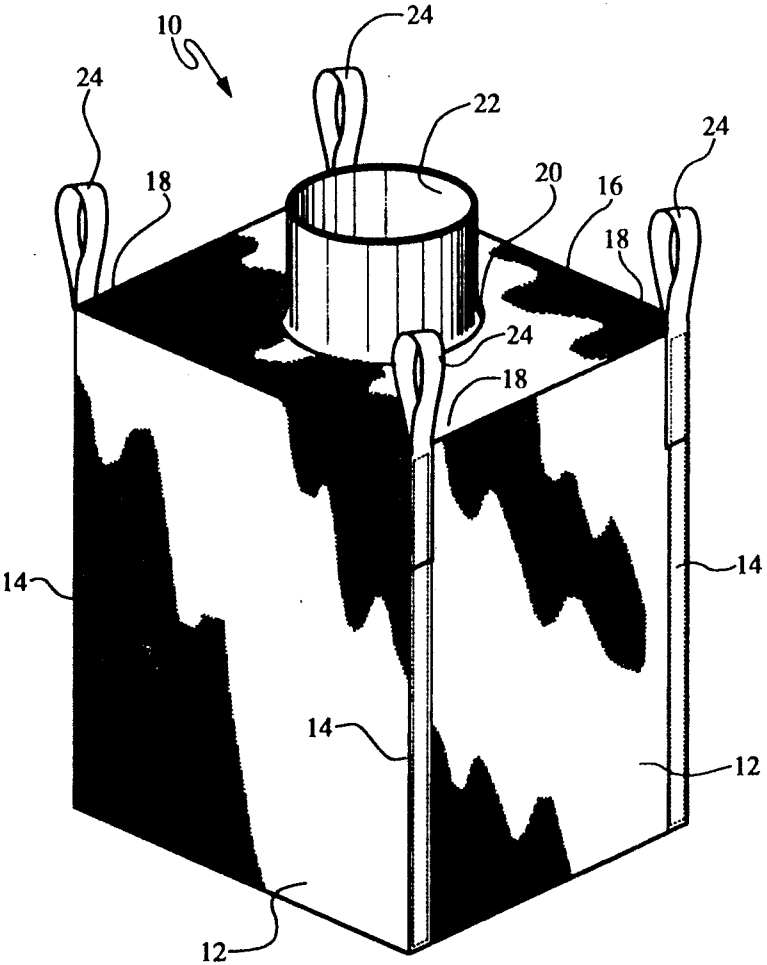
Fig.1 (PRIOR ART)
FIG. 1 is a front view of a prior art flexible bulk container with corner seams and corner lift straps.

Referring now to the Drawings more particularly to FIG. 1 thereof, there is shown a prior art flexible bulk container 10 comprising 4 side panels 12, seamed together along corner seams 14. A top panel 16 is attached to the upper edges of the panels 12 such that the corners 18 of the top panel 16 are attached at the seams 14.

For filling the container an opening 20 is placed in the center of the top panel 16, through which a fill spout 22 extends for filling the container. Lift straps 24 are attached to the panels 12 along the seams 14, for lifting the container 10. A bottom panel (not shown) is attached along the bottom edges of the side panels 12 such that the corners of the bottom panel are attached to the seams 14. The construction of the container 10 is such that, when filled, a substantial portion of the load is concentrated at the seams 14 and along the lift straps 24, thereby threatening the integrity of the filled container 10.

Figure 2:
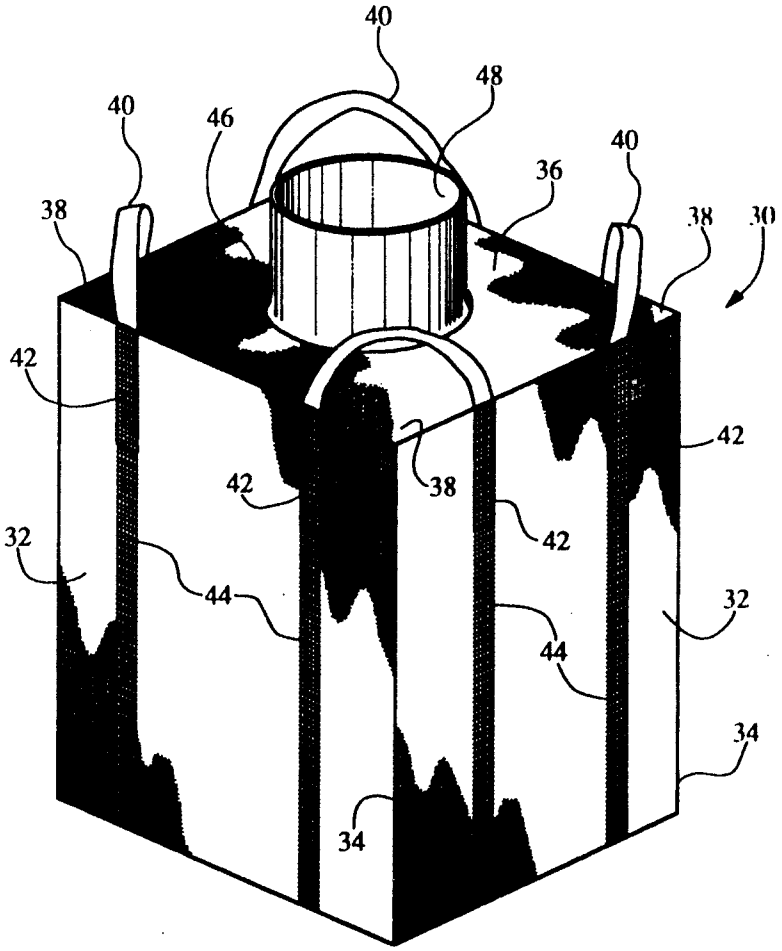
Fig.2 (PRIOR ART)
FIG. 2 is a front view of a prior art flexible bulk container with corner seams and lift straps attached at points away from the corners.

Referring now to FIG. 2, there is shown a second prior art container 30 having 4 side panels 32 connected at seams 34. A top panel 36 is attached to the upper edges of the side panels 32 such that the corners 38 of the top panel 36 are attached to the seams 34. A bottom panel (not shown) is attached to the lower edges of the panel 32 in the same manner as is the top panel 36.

Lift straps 40 having two opposed ends 42 are attached to the panels 32 at locations spaced away from the seams 34 such that each opposed end 42 of the lift strap 40 is attached to a panel 32 adjacent to the panel 32 to which the remaining end 42 of the lift strap is attached. To reinforce the attachment point of the lift straps 40 to the panels 32, a reinforced webbing 44 extends vertically the height of the panels 32 at the location of the attachment points of the lift straps to the panels 32. Alternatively, the reinforcing strip may be a more densely woven section of the panel self fabric.

To allow for filling of the container, there is an opening 46 located in the center of the top panel 36 through which a discharge spout 48 may extend. As with the prior art container 10, when the prior art container 30 is filled, a substantial portion of the load is asserted against the seams 34 located at the corners of the container 30 and along the attachment points of the lift straps 40 increasing the possibility of failure of the seams 34 and the straps 40 during lifting of a filled container.

Figure 3:
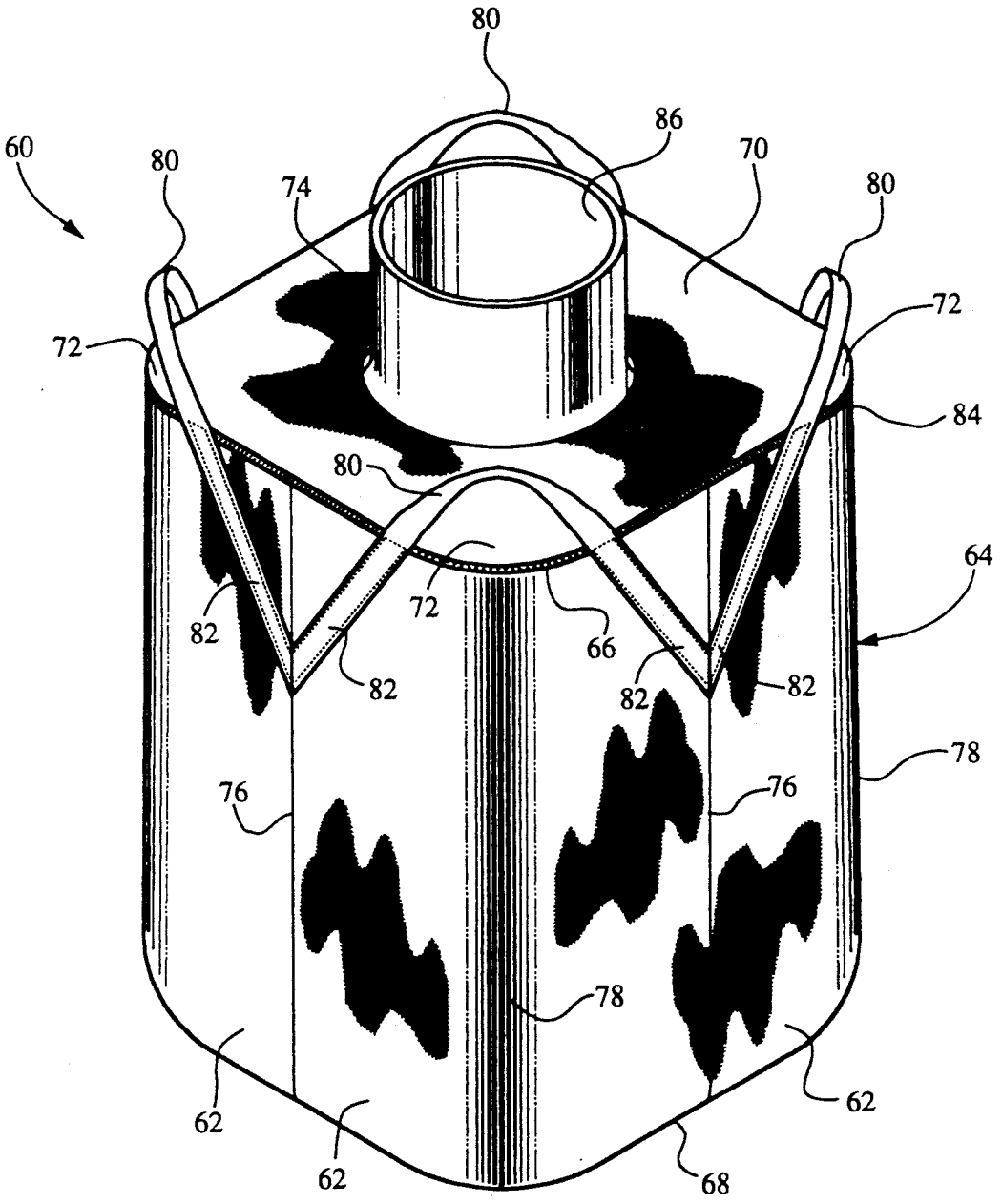
FIG. 3 is a front view of a flexible bulk container incorporating a first embodiment of the present invention.

A flexible bulk container 60 incorporating a first embodiment of the present invention as shown in FIG. 3, overcomes the foregoing problems by more evenly distributing the load stress throughout the container and away from the seams of the container. Side panels 62 are seamed together vertically to form a perimeter wall having a first end 66 and a second end 68. Attached to the first end 66 of the perimeter wall 64 is a top panel 70 having corners 72 and a fill opening 74 located in the center of the top panel 70. The top panel 70 is attached to the first end 66 of the perimeter wall 64 such that the corners 72 are attached to the perimeter wall points equal distance between adjacent seams 76 connecting the side panels 62 to form the perimeter wall 64. Thus, the seams 76 connecting the panels 62 are located in the perimeter wall at points midway between the corners 78 of the perimeter wall 64 formed by attaching the first end 66 of the perimeter wall 64 to the top panel 70.

A bottom panel (not shown) is attached to the second end 68 of the perimeter wall 64 in the same manner as the top panel 70 is attached to the first end 66 of the perimeter wall 64. The bottom wall (not shown) may have an opening in the center of the bottom panel similar to the fill opening 74 in the top panel 70, which opening in the bottom panel may be used for discharging flowable materials from the container 60.

Lift straps 80 having opposed ends 82 are attached to the perimeter wall 64 of the container 60 for lifting and transporting the container 60. Each of the opposed ends 82 of the lift strap 80 are attached to the perimeter wall 64 beginning at a predetermined point along adjacent seams 76 and extending for attachment diagonally upwardly and away from the seams 76 to a seam 84 connecting the top panel 70 to the first end 66 of the perimeter wall 64. A center portion of the lift strap 80 extends above the seam 84 to form a loop extending diagonally over the corner 72 of the top panel 70. Each lift strap 80 is attached to its individual associated side panel 62 prior to attachment of the side panels 62 to one another to form the perimeter wall 64, to thereby simplify construction of the container 60.

Figure 4:
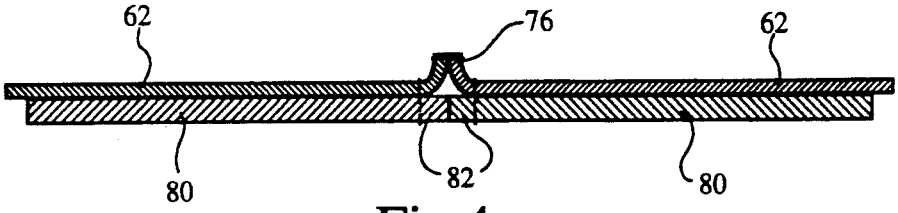
FIG. 4 is a sectional view showing attachment of one end of two adjacent lift straps to adjacent side panels of the container of FIG. 3.
Figure 5:
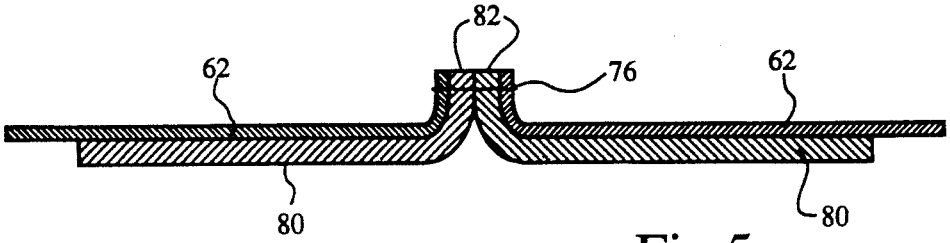
FIG. 5 is a sectional view illustrating attachment of one end of two adjacent lift straps to the container of FIG. 3 with the ends of the lift straps secured in the seam connecting two adjacent panels.
Figure 6:
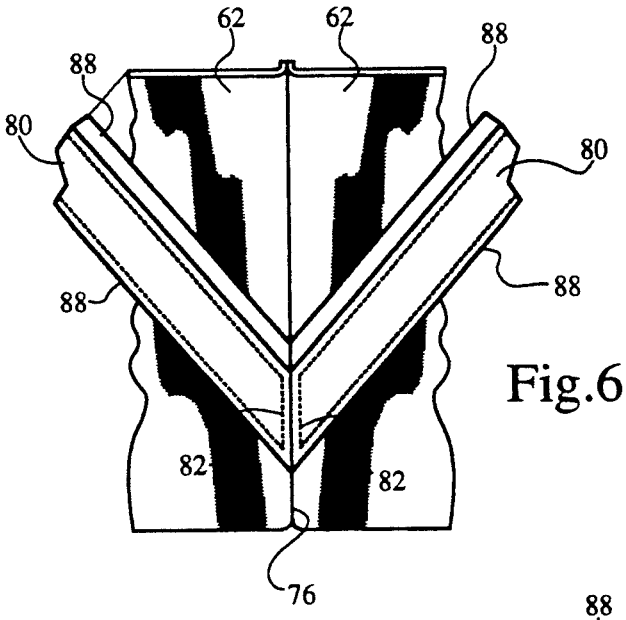
FIG. 6 is a partial front view illustrating attachment of two adjacent lift straps to the exterior of the container of FIG. 3.
Figure 7:
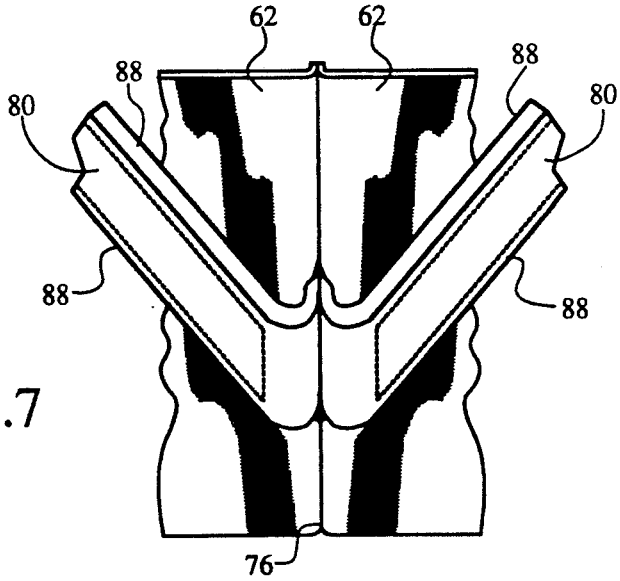
FIG. 7 is a partial front view illustrating attachment of two adjacent lift straps to the container of FIG. 3 wherein the ends of the lift straps are secured in the seam connecting adjacent side panel.

The ends 82 of the lift straps 80 may be secured within the seams 76, as illustrated in FIGS. 5 and 7, or may abut the end 82 of the next adjacent lift strap 80 on the exterior of the perimeter wall 64 at the seams 76, as shown in FIGS. 4 and 6. The lift straps 80 may be attached to the perimeter wall 64 by stitching along the opposed ends 82 and along opposed side edges 88 of the lift straps 80 to the point where the first end 66 of the perimeter wall 64 is attached to the top panel 70 and stitching diagonally across the lift straps 80 parallel to the seam 84 connecting the top panel 70 to the first end 66 of the perimeter wall 64 as shown in FIGS. 3 and 6. In the event the opposed ends 82 of adjacent lift straps 80 are secured within the seams 76, as shown in FIG. 7, the lift straps 80 may be attached to the perimeter wall 64 by stitching diagonally across the lift straps 80 immediately adjacent to the seams 76 and continuing diagonally upwardly therefrom along opposed side edges 88 of the lift straps 80 to the point where the first end 66 of the perimeter wall 64 is attached to the top panel 70 and stitching diagonally across the lift straps 80 parallel to the seam 84 connecting the top panel 70 to the first end 66 of the perimeter wall 64 as shown in FIG. 7.

As shown in FIG. 3, a fill spout 86 may extend through the opening 74 in the top panel 70 to allow filling of the container 60 with flowable materials. When the container 60 is filled, the location of the seams 76 away from the corners 78 of the container 60 and the location of the lift straps 80 to extend diagonally from the seams 76 to form a loop above the corners 72 of the top panel 70 results in better distribution of the load stress throughout the container, thereby reducing the possibility of failure along the seams 76 and the lift straps 80.

Figure 8:
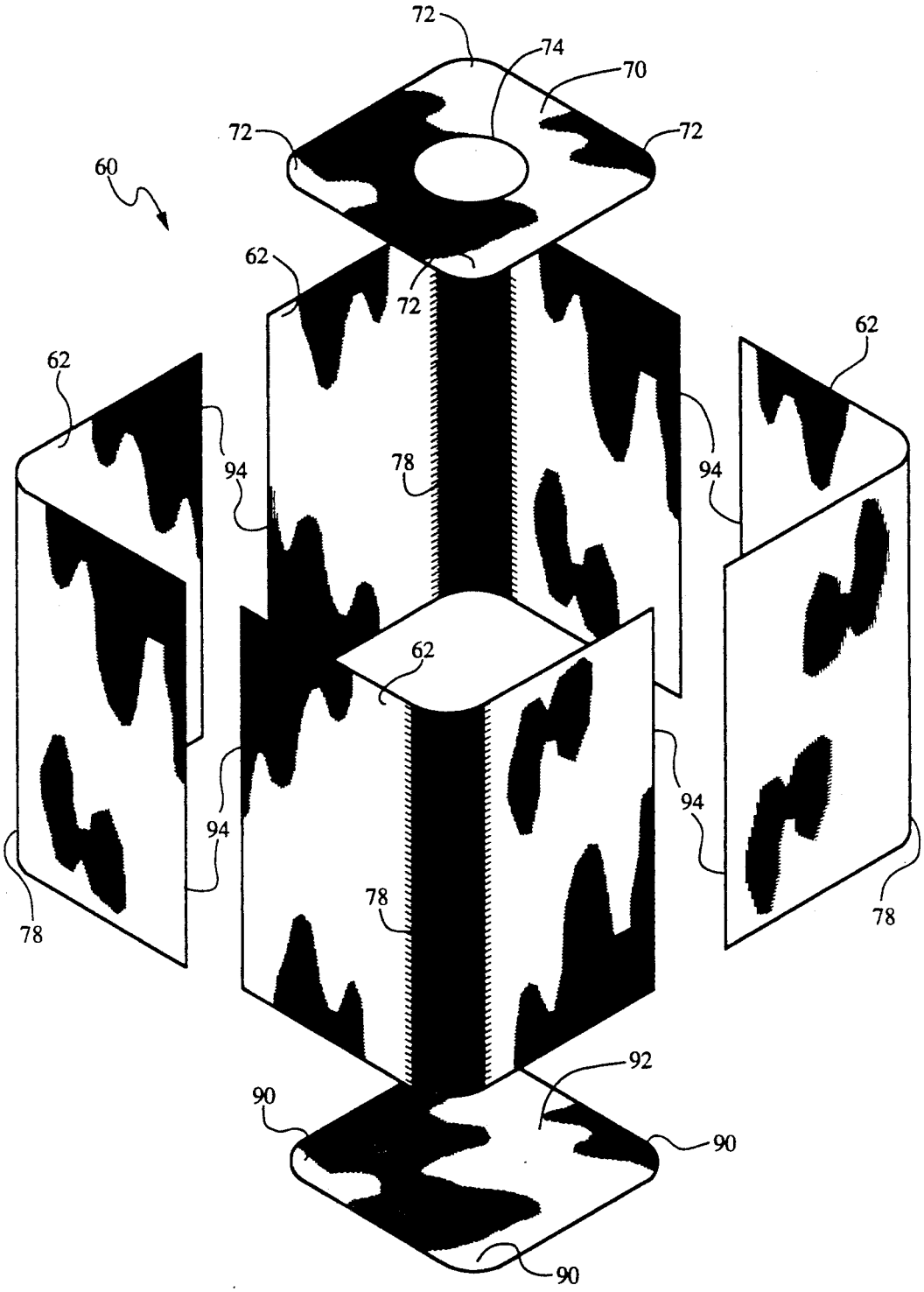
FIG. 8 is an exploded view of the container of FIG. 3.

Referring now to FIG. 8, there is shown an exploded front view of the container 60 illustrating the positioning of the corners 72 of the top panel 70 and corners 90 of a bottom panel 92 in relation to the side panels 62 and the seams 76 connecting opposed side edges 94 of the side panel 62 to form the perimeter wall 64. The positioning of the top panel 70 and the bottom panel 92 whereby the corners 72 and 90, respectively, are offset from the seams 76 connecting the side panels 62 results in the corners 78 in the perimeter wall 64 being located midway between the side edges 94 of each of the side panels 62.

Figure 9:
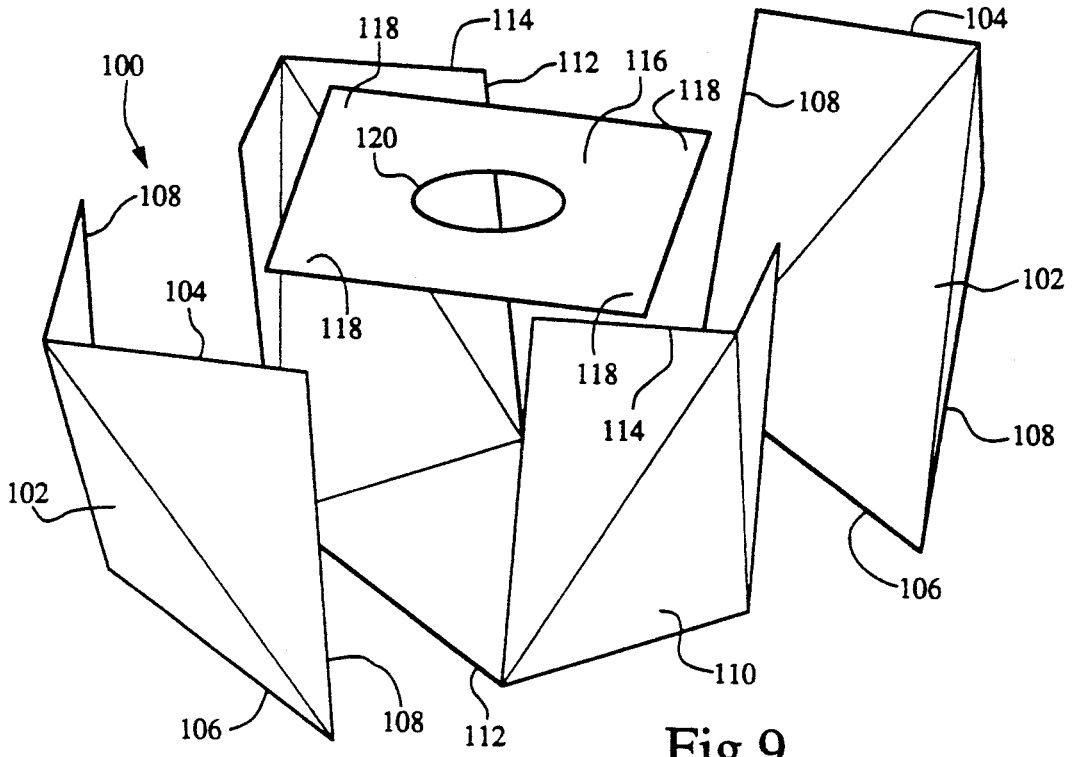
FIG. 9 is an exploded view of a flexible bulk container incorporating a second embodiment of the present invention.

A container 100 incorporating a second embodiment of the present invention is shown in FIG. 9. Two side panels 102, each having a top 104, a bottom 106 and two side edges 108 are attached to an elongate panel 110 having opposed elongate side edges 112 and opposed shorter end edges 114. The elongate side edges 112 are equal in length to the combined length of the bottom edge 106 and the two side edges 108 of a side panel 102. The side panels 102 are seamed to the elongate panel 110 along the elongate side edges 112 of the elongate panel 110 and along the side edges 108 and the bottom edge 106 of each of the side panels 102 to form the perimeter and bottom walls of the container 100.

A top panel 116 having corners 118 is attached to the top edges 104 of the side panels 102 and the opposed shorter end edges 114 of the elongate panel 110 such that the corners 118 are attached at points equidistant from the seams connecting the side panels 102 to the elongate panel 110. Thus, the top panel 116 is attached to the side panels 102 and elongate panel 110 in the same manner in which the top panel 70 is attached to the first end 66 of the perimeter wall 64 of container 60 shown in FIGS. 3 and 8.

Likewise, lift straps may be attached to the container 100 in the same manner in which the lift straps are attached to the container 60 as illustrated in FIGS. 3 through 7. As with container 60, a fill opening 120 is placed in the center of the top panel 116 to allow for the receiving and discharging of flowable materials from the container 100. Likewise, a separate discharge opening (not shown) may be placed in the center of the elongate panel 110 midway between the opposed elongate sides 112 and midway between the opposed shorter end edges 114 to discharge flowable materials from the container 100.

As with the container 60, the positioning of the top panel 116 in relation to the seams connecting the side panels 102 and the elongate panel 110, as well as the positioning of the lift straps to extend diagonally from the seams connecting the panels to loop diagonally above the corners 118 of the top panel 116, results in more even distribution of load stress throughout the container 100 when filled. Furthermore, the use of a single elongate panel 110 instead of using four side panels and a separate bottom panel results in additional container strength. Such construction, thereby reduces the possibility of failure of the container 100 along seam lines as well as along the attachment points of the lift straps to the container 100.

Figure 10:
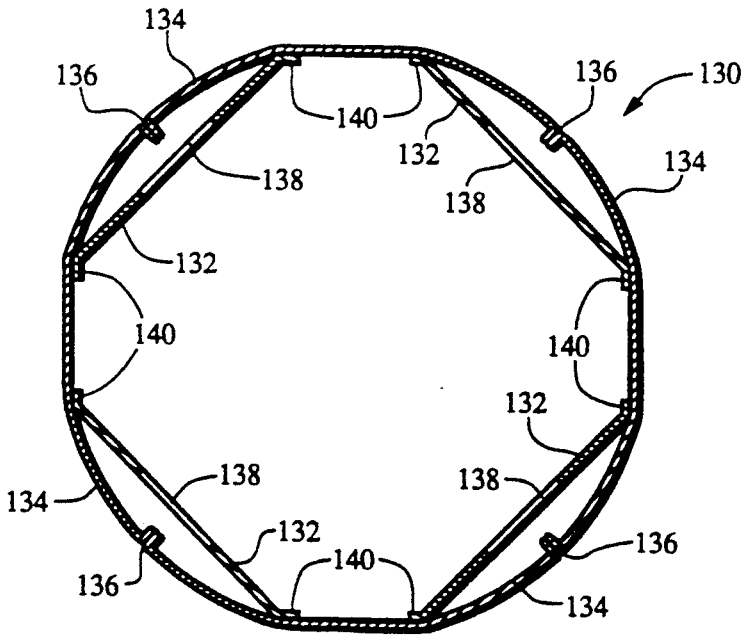
Fig.10 (PRIOR ART)
FIG. 10 is a sectional top view of a prior art container with corner seams and bridge panels.

Referring now to FIG. 10 there is shown a top sectional view of a prior art container 130 similar to those illustrated in FIGS. 1 and 2. Bridge panels 132 have been attached to the interior of the container 130 in an attempt to maintain a more square shape upon filling of the container. As illustrated, each bridge panel 132 is attached to two adjacent side panels 134 with a seam 136 connecting the side panels 134 falling between the seams attaching the bridge panel 132 to the two adjacent side panels 134. The seams 136 are located at the corners of the container 130 such that the bridge panels 132 function as a bridge across the corners, thus bridging the seams 136, to achieve a more square shape in the container 130 when filled. Openings 138 in the bridge panel 132 allow the movement of flowable materials into the interior area 140 defined by the bridge panel 132 and that portion of each of the side panels extending between the seam 136 connecting the adjacent side panels and the attachment points 140 of the bridge panels 132 to the adjacent side panels 134.

The construction of the prior art container 130 having bridge panels 132 to bridge the corners of the container wherein the seams 136 are located, results in difficulty in attaching the bridge panels 132 to adjacent side panels 134 requiring the handling of multiple panels while attaching the bridge panels 132.

Figure 11:
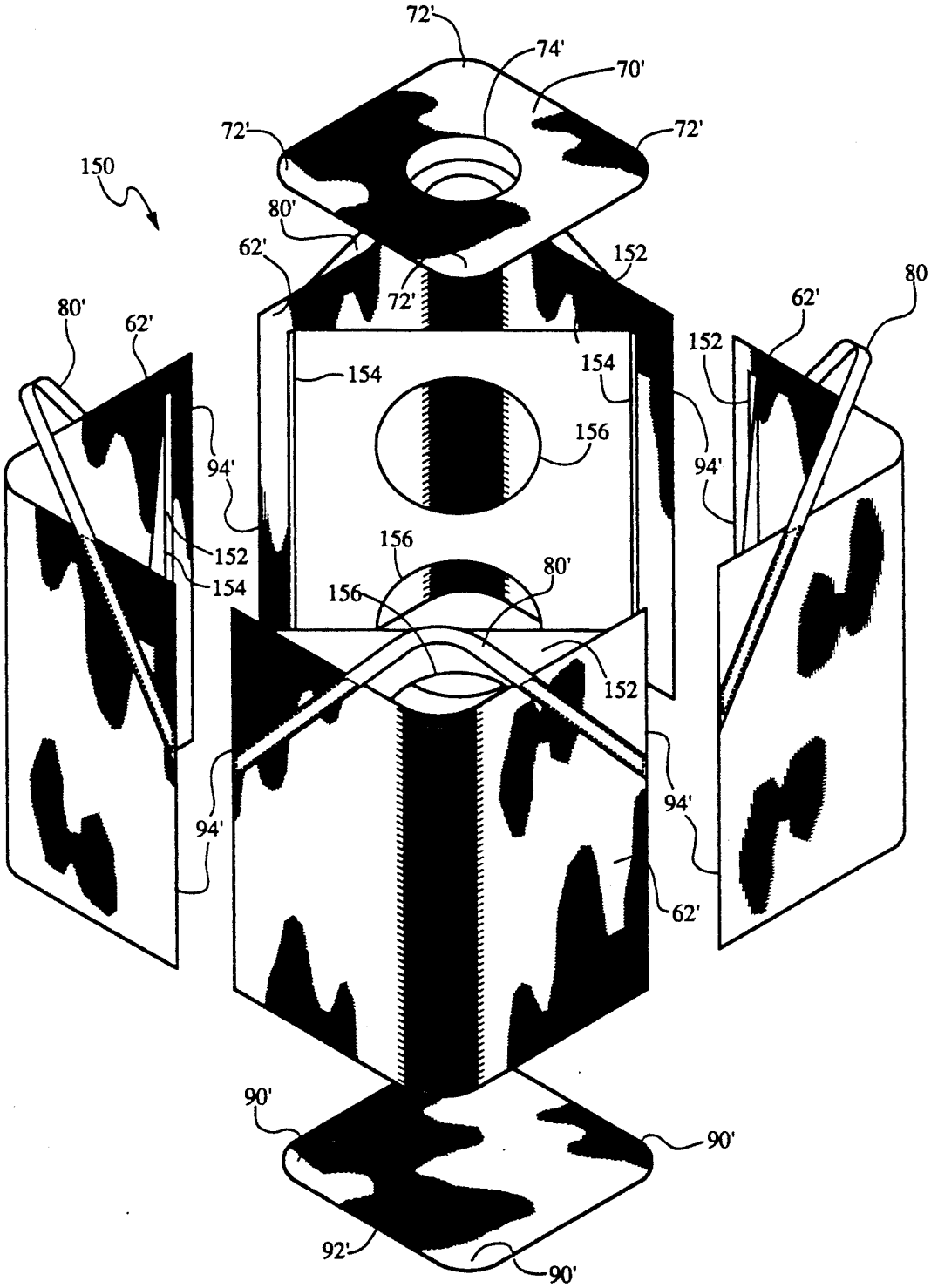
FIG. 11 is an exploded front view of a flexible bulk container incorporating a third embodiment of the present invention.
Figure 12:
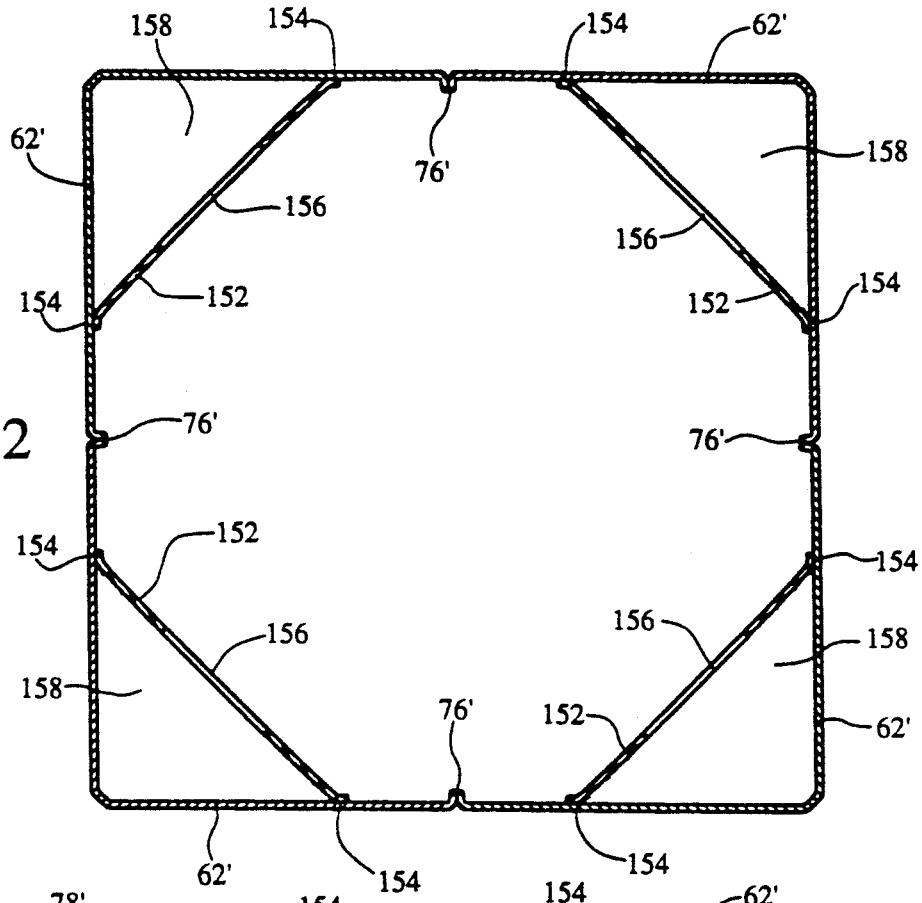
FIG. 12 is a sectional top view of the container of FIG. 11.
Figure 13:
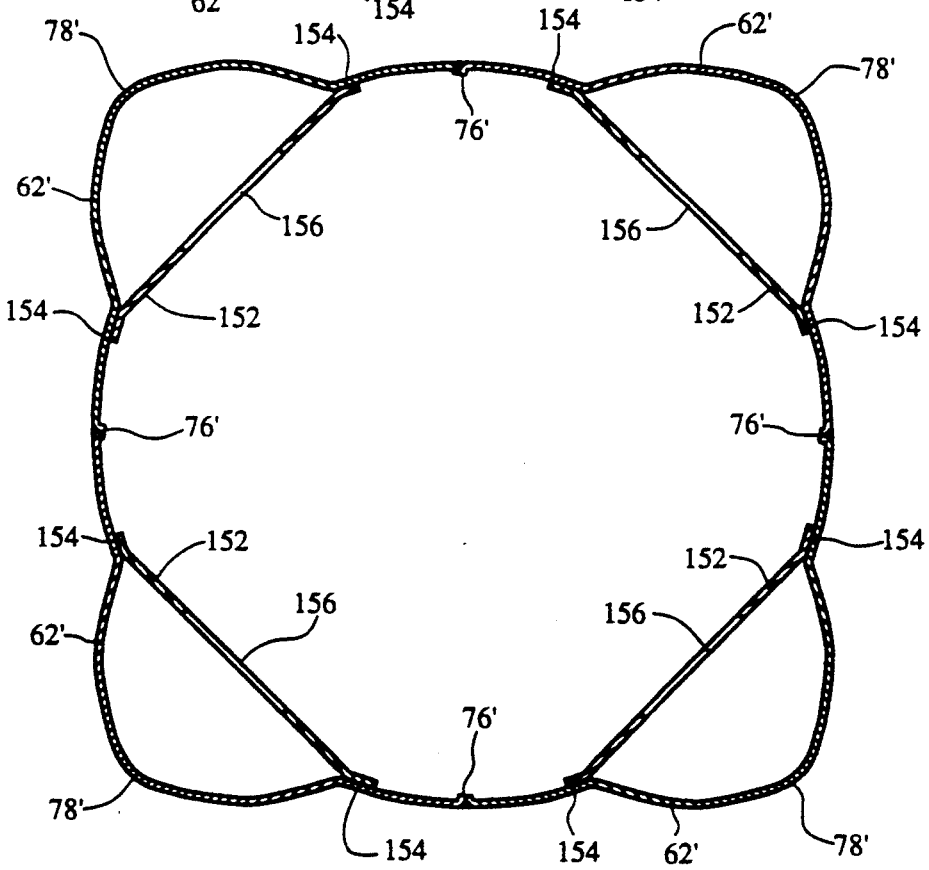
FIG. 13 is a sectional top view of the container of FIG. 11 illustrating the shape of the container when filled.

Referring now to FIGS. 11, 12, and 13, there is shown a container 150 incorporating a third embodiment of the present invention. Many of the elements of the container 150 are similar to those of the container 60 of FIG. 3 and will be given the same reference numerals with the elements of the container 150 being differentiated by a prime "'" designation. The container 150 overcomes the construction problems associated with prior art containers incorporating bridge panels by allowing attachment of each bridge panel 152 to a single side panel 62'. Each bridge panel 152 is substantially the same height as the side panels 62', but shorter in width than are the side panels 62'. The bridge panels 152 are attached to the side panels 62' along vertical attachment points 154 spaced a predetermined distance away from side edges 94' of the side panels 62'. A plurality of openings 156 in the bridge panels 152 allow the flowable materials to move into an area 158, as shown in FIG. 12, defined by the bridge panel 152 and that portion of the side panel 62' located between the vertical attachment points 154.

Attachment of each bridge panel 152 to a single side panel 62' simplifies the construction of the container 150 and requires the handling of only two panels at a time while attaching the bridge panels 152 to the side panels 62'. Thus, as shown in FIG. 12, the seams 76' connecting the adjacent side panels 62' may be formed after the bridge panels 152 have been attached to the side panels 62', simplifying the construction process of the container 150.

When filled, as illustrated in FIG. 13, the bridge panels 152 are forced slightly outwardly toward the corners 78' in the perimeter wall 64' while, at the same time, allowing the container 150 to retain a substantially square shape. Likewise, bridge panels 152 may be inserted and attached to the side panels 102 and portions of the elongate panel 110 extending parallel to the side edges 108 of the side panels 102 of the container 100 in the same manner in which the bridge panels 152 are attached to the side panels 62' of container 150. Therefore, the containers of the present invention provide for greater structural integrity and simplified construction of containers incorporating bridge panels, to overcome problems experienced in the use of prior art flexible bulk containers to receive, transport store, and discharge flowable materials.

Containers 60, 100, and 150 are constructed in a more simplified manner than prior art containers. In the construction of containers 60 and 150, each of lift straps 80 is attached to its associated side panel 62. If bridges 152 are being attached to the interior of the container, each is attached to its associated side panel 62. The order of attachment of the lift straps 80 and the bridge panels 152 to the side panels 62 may be reversed without effecting the simplified method of construction. Thereafter, the side panels 62 are attached to one another to form the perimeter wall 64 of the container.

Subsequently, the top panel 70 is attached along its perimeter to the first end 66 of the perimeter wall 64 such that the corners 72 of the top panel 70 are located equidistant from the seams 76 connecting adjacent side panels 62. Next, the bottom panel 92 is attached along its perimeter to the second end 68 of the perimeter wall 64 in the same position in relation to the second end 68 as the top panel 70 is positioned in relation to the first end 66 of the perimeter wall 64.

Figure 14:
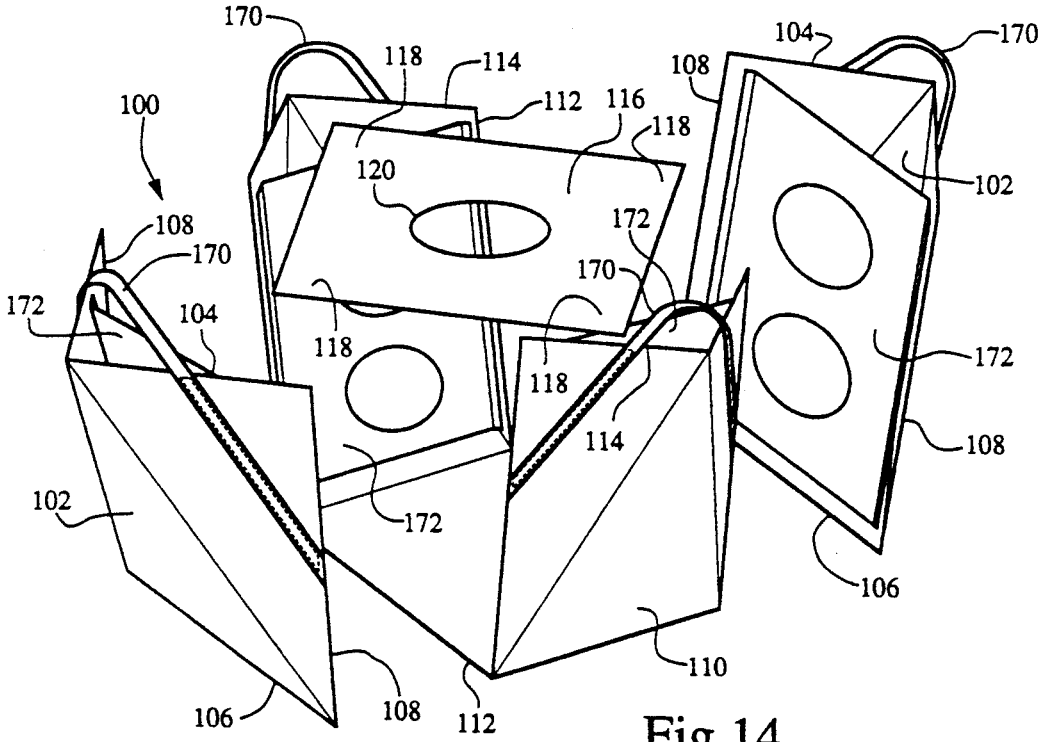
FIG. 14 is an exploded view of a flexible bulk container incorporating a fourth embodiment of the present invention.

Referring now to FIG. 14, as with containers 60 and 150, first each lift strap 170 of container is attached to its associated panel, with one lift strap 170 of container 10 being attached to each of the side panels 102 and two lift straps 170 being attached to the elongate panel 110, one at each end thereof. Thereafter, if bridges 172 are attached, each bridge 172 is attached to its associated panel, with one bridge 172 attached to each of the side panels 102 and two bridges 172 being attached to the elongate panel 110, one at each end thereof. The order of attachment to the panels of the lift straps 170 and the bridges 172 may be reversed without effecting the simplicity of the method of construction of the container.

Next, the side panels 102 are attached to the elongate panel 110 along the elongate side edges 112 of the elongate panel 110 and along the side edges 108 and the bottom edge 106 of each of the side panels 102. Finally, the top panel 116 is attached along its perimeter to the perimeter wall of the container along the top edges 104 of the side panels 102 and the opposed shorter end edges 114 of the elongate panel 110, such that the corners 118 are located equidistant from the seams connecting the side panels 102 to the elongate panel 110.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the spirit of the invention.

I claim:

1. A flexible container for receiving, transporting, and storing flowable materials comprising:

two side panels each having four edges;

one elongate panel having a pair of opposed elongate edges and a pair of opposed shorter edges and seamed along the length of said elongate edges to three sides of each of the side panels to form an upwardly open container;

a top panel having four corners and seamed to the remaining edge of each of the side panels and to the opposed shorter edges of the elongate panel such that the corners of the top panel are attached at points equidistant from the seams connecting the side panels to the elongate panel; and at least one strap having two opposed ends with said opposed ends of the strap attached to the container at adjacent seams connecting a side panel to the elongate panel with a center portion of the strap extending above the top panel to form a loop.

2. The container of claim 1, further comprising an opening located in the center of the top panel for receiving and discharging flowable materials.

3. The container of claim 1, further comprising an opening in the elongate panel midway between the opposed elongate edges and midway between the opposed shorter edges for discharging flowable material from the container.

4. The container of claim 1, wherein the straps are attached to the container beginning at the end of the strap and continuing diagonally upwardly to the point where the center portion of the strap extends above the top panel.

5. The container of claim 1, wherein the ends of the straps are sewn into the seams connecting the side panels to the elongate panel.

6. The container of claim 5, wherein the straps are attached to the container beginning at the seam connecting the side panels to the elongate panel and continuing diagonally upwardly to the point where the center portion of the strap extends above the top panel.

7. The container of claim 1, further comprising at least one bridge panel having two pairs of opposed edges and attached vertically along one pair of said opposed edges to the interior of the container adjacent to contiguous seams connecting the side panels to the elongate panel.

8. A flexible container for receiving, transporting, and storing flowable materials comprising:

two side panels each having a bottom, a top, and two side edges;

one elongate panel having first and second opposed edges equal in length to the total length of the bottom and the two side edges of one side panel and third and fourth opposed shorter edges and attached along the length of said first and second opposed edges to the two side and the bottom edges of said side panels to form an upwardly open container having a substantially square shape;

a top panel having four corners and seamed to the top edges of the side panels and the third and fourth opposed edges of the elongate panel such that the corners of the top panel are attached at points equidistant from the seams connecting the side panels to the elongate panel; and at lease one strap having first and second ends with the first end of the strap attached to the container at one of the seams connecting one of the side panels to the elongate panel and the second end of the strap attached to the container at the next adjacent seam connecting one of the side panels to the elongate panel with a center portion of the strap extending above the top panel to form a loop.

9. The container of claim 8, further comprising an opening located in the center of the top panel for receiving and discharging flowable materials.

10. The container of claim 8, further comprising an opening in the elongate panel midway between the first and second opposed edges and midway between the third and fourth opposed edges for discharging flowable material from said container.

11. The container of claim 8, wherein the straps are attached to the container beginning at the end of the strap and continuing diagonally upwardly to the point where the center portion of the strap extends above the top panel.

12. The container of claim 8, wherein the ends of the straps are sewn into the seams connecting the side panels to the elongate panel.

13. The container of claim 12, wherein the straps are attached to the container beginning at the seam connecting the side panels to the elongate panel and continuing diagonally upwardly to the point where the center portion of the strap extends above the top panel.

14. The container of claim 12, further comprising at least one bridge panel having two pairs of opposed edges and attached vertically along one pair of said opposed edges to the interior of the container adjacent to contiguous seams connecting the side panels to the elongate panel.

15. A flexible container for receiving, transporting, and storing flowable materials comprising:

two side panels each having a bottom, top, and two side edges;

one elongate panel having first and second opposed edges equal in length to the total length of the bottom and the two side edges of one side panel and having third and fourth opposed shorter edges and attached along the length of said first and second opposed edges to the two side and the bottom edges of said side panels to form an upwardly open container having a substantially square shape;

a top panel having four corners and an opening in the center of said top panel for receiving and discharging flowable materials and seamed to the top edges of the side panels and the third and fourth opposed edges of the elongate panel such that the seams connecting the side panels to the elongate panel are seamed to the top panel at points equidistant from adjacent corners of the top panel; and at lease one strap having first and second ends with the first end of the strap attached to the container at one of the seams connecting one of the side panels to the elongate panel and continuing diagonally upwardly to the seam connecting the top panel to the side panels and the elongate panel and the second end of the strap attached to the container at the next adjacent seam connecting the elongate panel to one of the side panels and continuing diagonally upwardly to the seam connecting the top panel to the side panels and the elongate panel with the center portion of the strap extending above the top panel to form a loop for lifting and suspending the container.

16. The container of claim 15, further comprising an opening in the elongate panel midway between the first and second opposed edges and midway between the third and fourth opposed edges for discharging flowable materials from said container.

17. The container of claim 15, wherein the ends of the straps are sewn into the seams connecting the side panels to the elongate panel.

18. The container of claim 15, further comprising at least one bridge panel having two pairs of opposed edges and attached vertically along one pair of said opposed edges to the interior of the container adjacent to contiguous seams connecting the side panels to the elongate panel.

* * * * *